US009463345B2

(12) United States Patent
Simonetti

(10) Patent No.: US 9,463,345 B2
(45) Date of Patent: Oct. 11, 2016

(54) WEIGHT LIFTING AND SELECTOR PIN ASSEMBLY

(71) Applicant: Bronze Fist Design, Inc., Foxboro, MA (US)

(72) Inventor: Dominic A. Simonetti, Hermosa Beach, CA (US)

(73) Assignee: Bronze Fist Design, Inc., Foxboro, MA (US)

( * ) Notice: Subject to any disclaimer, the term of this patent is extended or adjusted under 35 U.S.C. 154(b) by 0 days.

(21) Appl. No.: 14/473,262

(22) Filed: Aug. 29, 2014

(65) Prior Publication Data

US 2016/0059062 A1 Mar. 3, 2016

Related U.S. Application Data

(63) Continuation-in-part of application No. 14/076,461, filed on Nov. 11, 2013, which is a continuation-in-part of application No. 13/653,852, filed on Oct. 17, 2012, now abandoned.

(60) Provisional application No. 61/629,443, filed on Nov. 18, 2011, provisional application No. 61/631,734, filed on Jan. 10, 2012, provisional application No. 61/824,189, filed on May 16, 2013.

(51) Int. Cl.
*A63B 21/062* (2006.01)
*A63B 21/00* (2006.01)

(52) U.S. Cl.
CPC ..... *A63B 21/00069* (2013.01); *A63B 21/062* (2013.01); *A63B 2021/0623* (2013.01)

(58) Field of Classification Search
CPC ..... A63B 21/062; A63B 21/0626; A63B 21/0628; A63B 21/063; A63B 21/0632; A63B 21/00069; A63B 21/00065; A63B 21/0624; Y10T 403/3933; Y10T 403/3981; Y10T 403/3966
USPC ..... 119/700
See application file for complete search history.

(56) References Cited

U.S. PATENT DOCUMENTS

| | | | | |
|---|---|---|---|---|
| 6,786,669 | B2 * | 9/2004 | Tsui | B64G 1/641 403/109.2 |
| 7,473,211 | B2 * | 1/2009 | Lee | A63B 21/0628 482/94 |
| 7,815,554 | B2 * | 10/2010 | Gibson | A63B 21/0628 482/100 |
| 7,871,357 | B2 * | 1/2011 | Gibson | A63B 21/0628 482/98 |
| 8,454,260 | B2 * | 6/2013 | Wilcoxson | A63B 21/063 403/315 |
| 2009/0227432 | A1 * | 9/2009 | Pacheco | A63B 21/0628 482/101 |

* cited by examiner

*Primary Examiner* — Loan H Thanh
*Assistant Examiner* — Megan Anderson
(74) *Attorney, Agent, or Firm* — Tsircou Law, P.C.

(57) ABSTRACT

A permanently affixed and travelling selector pin, car and weight plate selection mechanism for use with physical fitness equipment is disclosed including a segmented track and/or cut out cavern within the plate body for the car to travel within in either vertically or horizontally in order to select a different weight plate or cumulatively, more or less weight for an exercise. The selector pin and car mechanism features a selector pin which is not removable from the car and is inserted through the car which is contained by the track and or plate body shape and into a throughbore in the weight plate in order to engage with the selector stem.

20 Claims, 24 Drawing Sheets

WEIGHT LIFTING AND SELECTOR PIN ASSEMBLY

PRIORITY OF INVENTION

The present invention is a continuation in part of patent application Ser. No. 14/076,461 filed Nov. 11, 2013, which is a continuation in part of patent application Ser. No. 13/653,852, filed Oct. 17, 2012. The present invention further incorporates by reference and claims priority to Provisional Application No. 61/629,443, Filed Nov. 18, 2011, Provisional Application No. 61/631,734, Filed Jan. 10, 2012, and Provisional Application No. 61/824,189, Filed May 16, 2013.

FIELD OF THE INVENTION

The present invention relates to a weightlifting system and selector pin component thereof. In particular, this invention relates to a selector pin assembly, track and/or weight plate for use with body building equipment, and more particularly to a selector pin which is not removable from a car or ball which travels either along a track or within the weight plate bodies which can then be inserted through the car or ball and the track into a throughbore or selection point in a weight plate or through the car directly into the throughbore in order to safely, reliably and easily engage a connection union with a vertically or horizontally running selector stem.

BACKGROUND OF THE INVENTION AND PRIOR ART

A traditional weight stack for use on what is known in the commercial fitness industry as "selectorized" or "Nautilus" strength training machines incorporates a weight stack in which similar or identically sized or shaped weight plates are stacked vertically atop one another. Formed into each plate and in identical locations on each plate in the are four throughbores: three throughbores extending vertically from the top surface through to the bottom surface of a given plate and one horizontally extending throughbore from the front surface (i.e., the surface facing the person selecting the weight level for the machine) through to the rear surface opposite the front surface. Two of the three vertical throughbores are of the same size and are located equally and on either side of the third, centrally located and larger vertical throughbore.

Inserted downward through the two smaller vertical throughbores are poles or "guide rods," the purpose of which is to permanently affix the weight stack to the machine and to ensure proper alignment of the stack before, during and after the user performs an exercise on the machine. The third, centrally located and larger vertical throughbore is meant to accept a "selector stem" or third and moveable rod which is permanently attached to the topmost or highest plate on the weight stack but which is not permanently attached to any other plate in the stack. The selector rod is of at least equal length as the stacked plates forming the weight stack.

In these prior art systems, at the top of the selector stem a cable or belt which runs over a pulley or series of pulleys and/or cams and is attached at the other end to the "movement arm" which is the piece of the machine the user moves when performing the desired exercise. Formed horizontally through the selector stem are throughbores equal in number and vertically placed in an identical orientation to the horizontal throughbores formed from the front surface to the back surface of each individual weight plate. The purpose of this design is so that when a user wants to select the appropriate amount of resistance or weight desired to perform the exercise, that user inserts a "selector pin" into the horizontal throughbore on the surface of the weight stack and through the throughbore in the selector stem forming a non-permanent, selectable engagement so that when the user moves the movement arm, all plates above the temporary union formed by inserting the selector pin horizontally through the horizontal throughbore and selector stem are lifted vertically and against the force of gravity providing the strength training resistance when the user moves the movement arm and performs the exercise.

Although traditional weight stacks, such as those described above, have succeeded in carrying out the intended weight lifting purpose, there are many areas for substantial improvement.

One key problem often associated with traditional weight stacks is that the selector pin is removable and, as a result, is often misplaced, stolen or damaged whereupon it is replaced with a functionally and/or structurally inadequately sized pin. This inappropriate replacement historically has caused bodily injury when the system fails due to the violation of the inherent design of the apparatus.

The removable pin also permits the user to easily modify the operation of the apparatus outside the manufacturer's design criteria for the plates and/or weight stack, which can create unacceptable safety risks for the user and/or bystanders.

Additionally, there is a level of dexterity and hand to eye coordination required to insert the selector pin in the horizontal throughbore of the weight and the center post which further limits the true and effective result, and potentially frustrates the user such that the equipment receives less use.

In addition, an improper or incomplete mating between the selector pin and selector stem could result in an in situ decoupling with the weight stock dropping (through gravity) with potential for damage to the system and/or injury to bystanders standing in proximity to the weight stack.

Therefore, there exists a need for a safer, simpler and better arranged weight selection mechanism system such as the selector pin, car or ball and weight plate mechanism which cannot be misplaced, stolen or lost, and can be safely, simply and conveniently be engaged with thereby minimizing user error, complication and compromise in user safety.

Existing prior art approaches do not fully satisfy these problems. One approach calls for weight plates with rotating latches on the weight plates that once rotated engage with a groove molded into the center post (Itaru U.S. Pat. No. 5,306,221). This device, however, is overly complicated and unreliable with frequent slips and malfunctions.

There also exists a sliding plate mechanism (Reach U.S. Pat. No. 772,906), however, this approach also results in high manufacturing costs and creates inherent safety issues.

There also exists an imbedded system featuring a selector pin imbedded in a cartridge, imbedded in every weight plate and an external toggle lever switch mounted on the surface of each plate that is manipulated laterally from left to right on a weight stack (see, e.g., U.S. Pat. No. 7,608,021 to Nalley) by the user in order to engage the imbedded selector pin through the throughbore in order to engage the imbedded selector pin into the center post. This system is confusing to the user as one, more than one, or in fact all of the selector pins can be engaged at one time creating user confusion and numerous safety issues if and when the user mistakenly and dangerously attempts to perform an exercise with a weight amount he/she is physically incapable of lifting or moving.

Still another existing reference is to Pacheco (U.S. Pat. No. 8,152,702 B2) which purports to disclose a pulley based system which uppermost Weight plate of the plurality of Weight plates. A body is slidably coupled to the at least one rail. However this reference fails to teach the elimination of belts, pulleys or similar devices for transferring energy for the movement of a weight stack.

In addition to inherent safety issues in design or and confusion and unavoidable user error and/or injury, these latter devices and mechanisms are unable to be applied, added to or retrofitted onto existing exercise apparatus in the marketplace.

SUMMARY OF THE INVENTION

The selector pin of the present invention includes a variety of embodiments, but is generally displaced within and is not removable from a moveable car, ball or similar sliding mechanism which is continuously engaged but able to travel continuously the length of a horizontal or vertical weight stack either via a continuous, yet separable segmented track affixed to the surface of the plate body or within a continuous, yet separable cavity running internally within and the length of the weight stack, which is continuous and not separated when the user is not using the exercise apparatus. When the user is not performing exercise, the full weight stack is aligned, and the user may thus select and/or adjust the desired weight amount for exercise. The mobility of the car or ball and pin assembly allowing for the selector pin to be inserted into the selector pin throughbore in any weight plate in the weight stack in order to engage or disengage a connecting union with the center post running vertically or horizontally through the center throughbore of the weight stack without allowing the selector pin to ever be removed from the car or ball which in turn is continuously engaged with the track, cavern or recess within the weight stack.

In certain preferred embodiments, the selector pin is slightly larger at the tip or has a similar preventive design (e.g., a ball) which allows disengagement from the selector stem and withdrawal from the throughbore and allowing for car travel within the segmented track or continuous cavern, but preventing removal from the car. Likewise, in such embodiments, the selector pin has a knob or other gripping surface on the user end, or a vertically rotating or horizontally rotating latch or lever, preventing the pin from being pushed through the car when inserted through the car and into the selector pin borehole for engagement with the centerpost or selector stem. In one preferred version, the selector pin and car mechanism have spring-loaded ball bearings embedded in the car and grooves cut into the pin which accept the spring-loaded ball bearings which provide the user with tactile sensation when the pin is at its full insertion position or its full extracted position and may also have a locking mechanism further guaranteeing complete insertion and proper union with the centerpost.

The weights stack features of the present invention includes a number of embodiments. In a first version of a weight stack practicing the present invention, stacked weight plates for physical fitness equipment are employed, including a plate body with an upward, radial extending cavity (e.g., a "U-shaped" recess) allowing for acceptance of a horizontal centerbar or selector stem which is affixed to the exercise apparatus only at the movement arm end. The centerbar has multiple diametric throughbores to receive a selector pin which passes through a horizontal throughbore disposed intermediate to the opposing surfaces of the plate body and entering into the weight plate at a 90 degree angle to the tangent of the front surface of the weight plate. The horizontal bore connects the upward, radial extending cavity with a horizontally running internal cavity. A selector pin is movably mounted, but not removable from the movable car traveling within the horizontal internal cavity when the selector pin is disengaged from the selector stem within the radial extending cavity. Thus, each plate may be independently selected by way of manually or otherwise inserting a selector pin. The horizontally stacked weight plates, which can be made of steel, lead, iron, rubber, urethane or a composite are of a shape that as the moveable selector pin is engaged into a plate farther from the fixed end, all plates between the selected insertion point and the fixed end of the horizontal selector stem will provide resistance thereby allowing the user to select more or less weight with the use of only a single selector pin and car or sliding mechanism. As a result, once the selector pin is engaged with the centerbar or selector stem, all plates between the selected insertion point and the fixed end of the horizontal centerbar will be lifted or moved via a cable, lever, belt, movement arm or lift apparatus or the like.

In a second version of the weight stack employed by the present invention, horizontally stacked weight plate for physical fitness equipment is disclosed including a plate body with an upward, radial extending cavity allowing for acceptance of a horizontal centerbar which is affixed to the exercise apparatus only at one end which has multiple diametric throughbores to receive a selector pin which passes through a segmented track connected to the front surface of the weight plate and connected to the central throughbore by a horizontal bore disposed intermediate the opposing surfaces of the plate body and entering into the weight plate through the segmented track at a 90 degree angle to the tangent of the front surface of the weight plate. A selector pin is movably mounted, but not removable from the movable car traveling within the segmented track when the selector pin is disengaged from the selector stem within the radial extending cavity. Thus each plate may be independently selected by way of manually or otherwise inserting a selector pin. The horizontally stacked weight plates which can be made of steel, lead, iron, rubber, urethane or a composite are of a shape that as the moveable selector pin is engaged into a plate farther from the fixed end of the selector stem, all plates between the selected insertion point and the fixed end of the horizontal selector stem will provide resistance thereby allowing the user to select more or less weight with the use of only a single selector pin and car mechanism. As a result, once the selector pin is engaged with the centerbar all plates between the selected insertion point and the fixed end of the horizontal centerbar will be lifted or moved via a cable, lever, belt, movement arm or lift apparatus or the like.

In a third embodiment, a vertically stacked weight plate for physical fitness equipment is disclosed including a plate body with central throughbore for connection and at least one, preferably two, throughbores which pass vertically therethrough for receiving guide rods or the like. The plate body additionally has an internal cavity connected to the central throughbore by a horizontal bore disposed intermediate the opposing surfaces of the plate body and entering into the weight plate at a 90 degree angle to the front surface of the weight plate. Typically, the horizontal bore intersects the central vertical throughbore. A selector pin is movably mounted, but not removable from the movable car traveling within the additional internal cavity when the selector pin is disengaged from the center post within the third, center borehole. The center post has multiple diametric throughbores to receive the selector pin which passes through the fourth throughbore and forms a connection with the center post. Thus, each plate may be independently selected by way of manually inserting or otherwise engaging the selector pin when the travelling car is moved to the appropriate level or weight plate. As a result of such selection, once the selector pin is engaged with the center post all weight plates above the weight plate where the selector pin is inserted or otherwise engaged with the center post will be lifted or moved via a cable, lever, belt, movement arm or lift apparatus or the like.

A fourth embodiment teaches a vertically stacked weight plate for physical fitness equipment, including a plate body with central throughbore for connection and at least one, preferably two, throughbores which pass vertically therethrough for receiving guide rods or the like. The plate body additionally has an external segmented track (e.g., a track which could be retrofitted to existing weight stack configurations), where the track connected to the front surface of the weight plate and connected to the central throughbore by a horizontal bore disposed intermediate the opposing surfaces of the plate body and entering into the weight plate through the segmented track at a 90 degree angle to the front surface of the weight plate. Typically, the horizontal bore intersects the central vertical throughbore. A selector pin is movably mounted, but not removable from the movable car which travels and is continuously engaged along the external track when the selector pin is disengaged from the center post within the third, center borehole. The center post has multiple diametric throughbores to receive the selector pin which passes through a selector pin throughbore and forms a connection with the center post. Thus, each plate may be independently selected by way of manually or otherwise inserting the selector pin when the travelling car is moved to the appropriate level or weight plate. Once the selector pin is engaged with the center post, all weight plates above the weight plate where the selector pin is inserted and engaged with the center post will be lifted or moved via a cable, lever, belt, movement arm or lift apparatus or the like.

Thus, one object of the present invention is to provide a component for a weight lifting system which prevents the loss of a selector pin and the misuse of a weight training machine resulting from the loss thereof.

Another object of the present invention is to provide a selector pin and related car, ball or holder thereof which enables the continuous connection of the selector pin to a weight lifting device.

Still another object of the present invention is to provide a track or groove in a weight stack for a selector pin to enable the improved selection of a desired weight to be lifted.

Yet another object of the present invention is to provide a mechanism for the easy engagement of a selected weight level so as to reduce the possibility of an improper mating of the selector pin and the weight stack, thereby reducing the possibility of any in situ failure of the weight lifting machine.

Yet another object of the present invention is to provide a weight lifting machine that can eliminate the need for belts, pulleys or similar devices for transferring energy for the movement of a weight stack.

It should be noted that not every embodiment of the claimed invention will accomplish each of the objects of the invention set forth above. In addition, further objects of the invention will become apparent based on the summary of the invention, the detailed description of preferred embodiments, and as illustrated in the accompanying drawings. Such objects, features, and advantages of the present invention will become more apparent in light of the following detailed description of a best mode embodiment thereof, and as illustrated in the accompanying drawings.

DETAILED DESCRIPTION OF THE INVENTION

Figure 1:
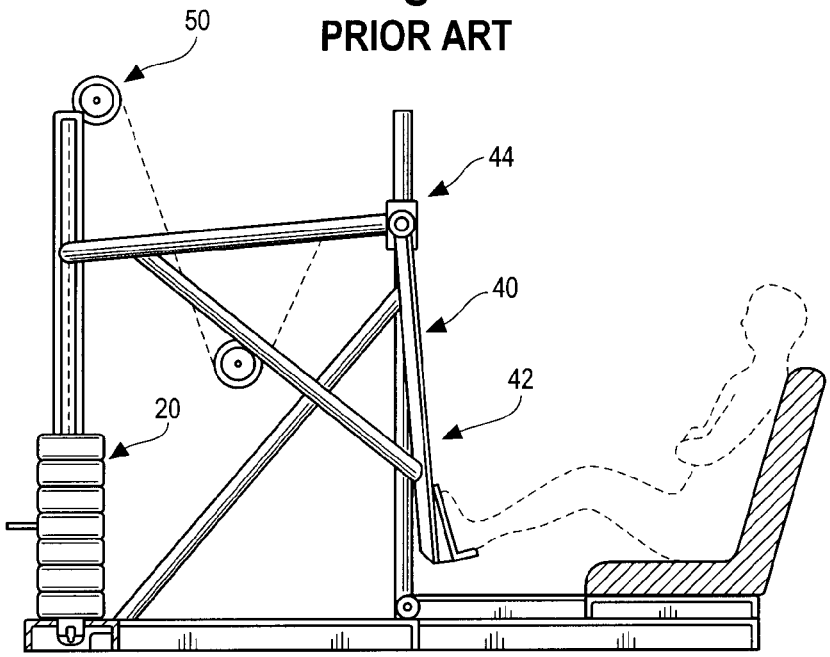
Fig. 1 PRIOR ART
FIG. 1 is a side view of a weight plate assembly known in the prior art.

Set forth below is a description of what is currently believed to be the preferred embodiment or best examples of the invention claimed. Future and present alternatives and modifications to this preferred embodiment are contemplated. Any alternatives or modifications which make insubstantial changes in function, in purpose, in structure or in result are intended to be covered by the claims in this patent.

A typical weight lifting apparatus 10 as known in the prior art is shown by way of example in FIGS. 1-4. Generally, such an apparatus 10 includes a weight stack assembly 20, a movement assembly 40 for receiving work or force from a user, and a pulley system 50 to facilitate or translate the gravitational force from the weight stack assembly 20 so as to provide resistance to the movement assembly 40. The movement assembly 40 typically includes a movement arm 42 which is displaced by the user during exercise, and a pivot point 44 which permits rotation of the user's force against the resistance of the weight stack assembly.

Figure 2:
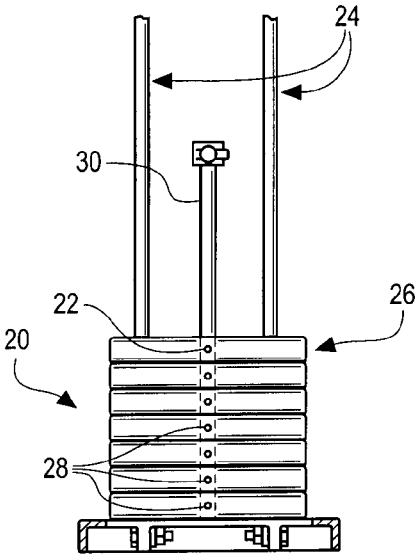
Fig. 2 PRIOR ART
FIG. 2 is a front view of the weight plate stack with guide rods and a selector stem as known in the prior art.

As shown in FIG. 2, the weight stack assembly 20 typically comprises a selector pin 22 so that the user can select the appropriate level of weight or resistance, a series of guide rods 24 for aligning and supporting the weight stack assembly 20 during exercise, and a series of plates 26, each plate having a weight plate throughbore 28 for receiving a selector pin 22. Thus, as a user selects a given weight plate throughbore 28, only that portion of weight stack assembly 20 which is at the level of the selector pin or above is engaged.

Figure 3:
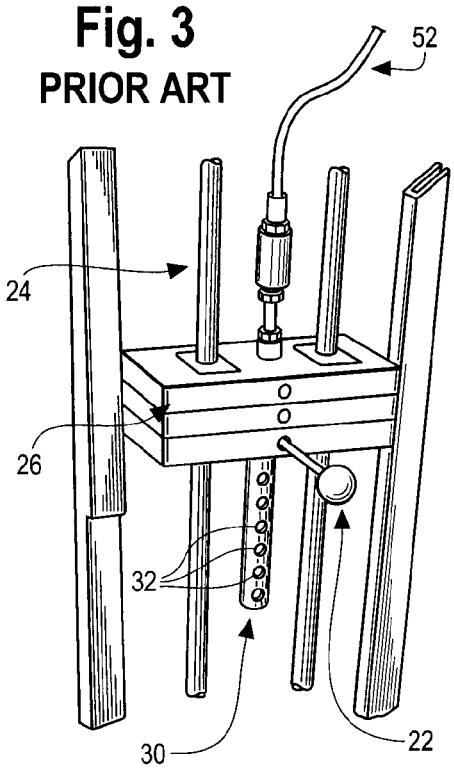
Fig. 3 PRIOR ART
FIG. 3 is a perspective in situ view of the weight plate stack with guide rods and selector stem shown of FIG. 2 in the assembled condition with the selector pin in the engaged position.
Figure 4:
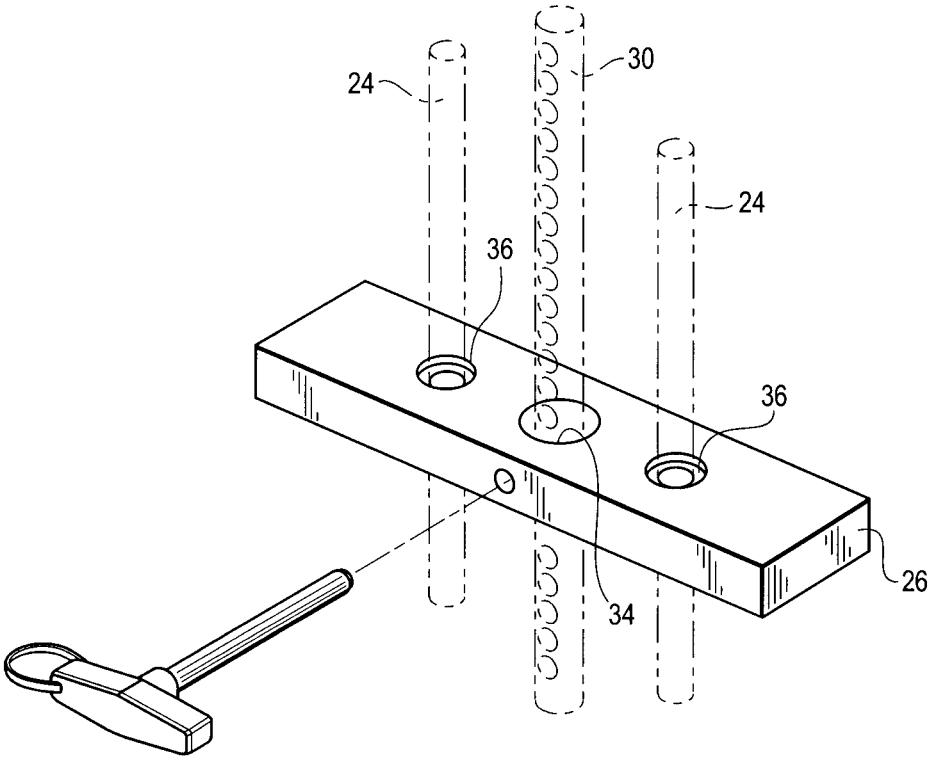
Fig. 4 PRIOR ART
FIG. 4 is an exploded view of a weight plate and selector pin engagement as known in the prior art

As shown in FIG. 3, the connection between the selector pin 22 and the cable 52 of pulley system 50 is accomplished by a selector stem 30. The selector stem 30 is typically permanently attached to the weight plate 26 which is at the top of the stack. The selector stem further includes a series of throughbores 32 which receive the selector pin 22 extending through the weight plate throughbore 28. As shown in FIG. 4, the weight stack assembly 20 further includes a selector stem bore 34 and guide rod bores 36 for receiving the selector stem 30 and guide rods 24, respectively.

Figure 5:
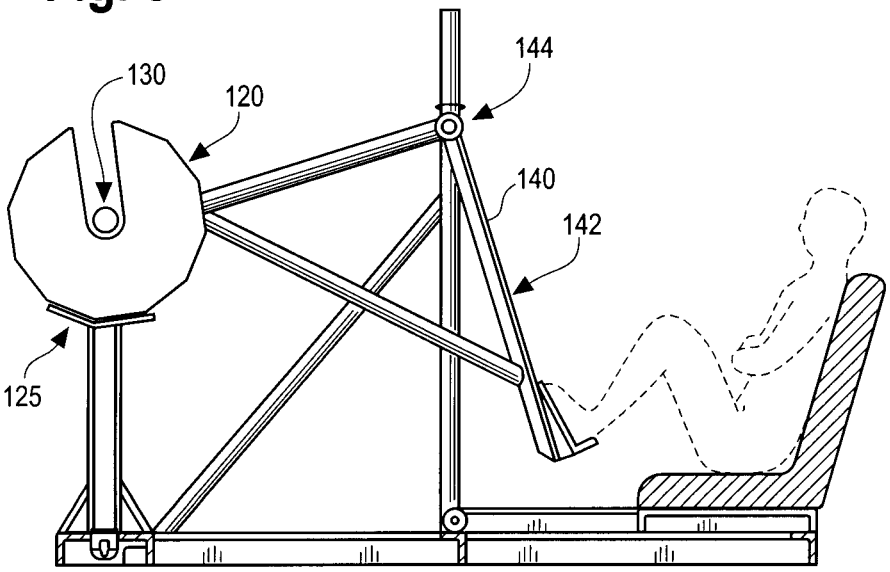
FIG. 5 shows a side view of a weight stack assembly in accordance with some of the preferred embodiments of the present invention.
Figure 6:
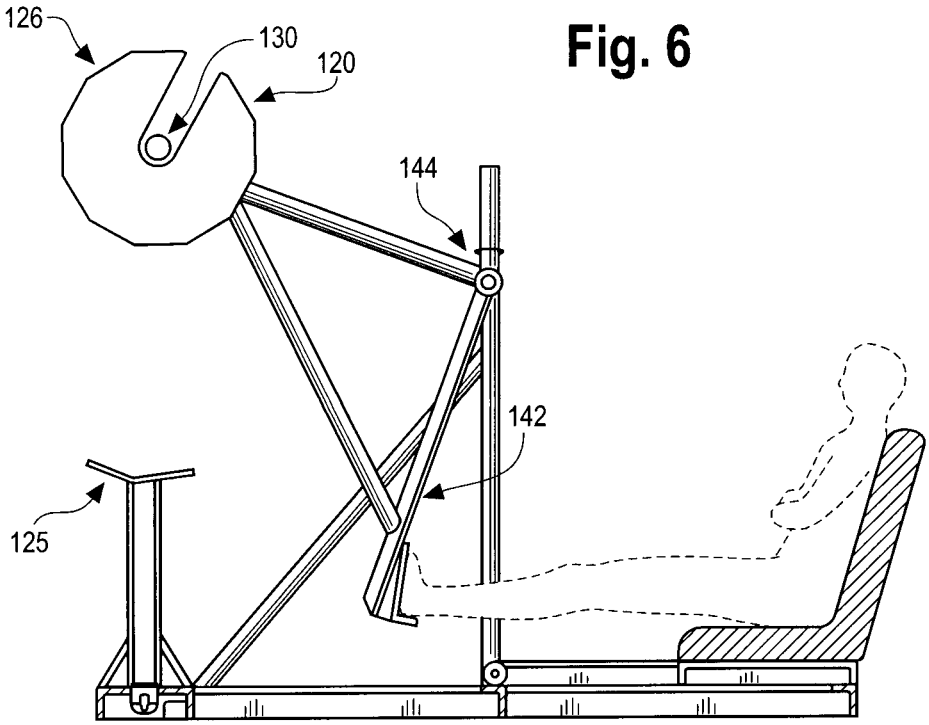
FIG. 6 shows a side view of a weight stack assembly in accordance with some of the preferred embodiments of the present invention in operation wherein the user has selected to lift all weights in the stack, leaving the tray empty.
Figure 7:
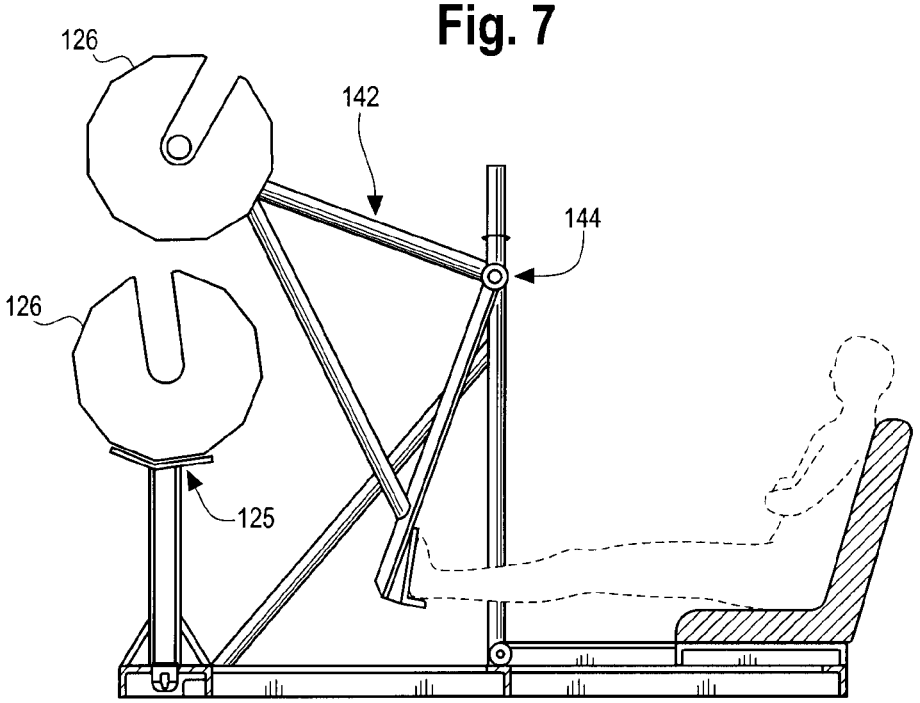
FIG. 7 shows a side view of a weight stack assembly in accordance with some of the preferred embodiments of the present invention in operation wherein the user has selected to lift only a portion of the weights in the stack, leaving the remaining weight plates in the tray.

By comparison, a first preferred embodiment of a weight lifting apparatus 110 of the present invention is shown in FIGS. 5-7. In this embodiment, the weight lifting apparatus, includes a movement assembly 140 comprising movement arm 142 and pivot point 144, a weight stack assembly 120 (which is supported at rest by tray 125), and a selector stem 130. However, in this embodiment, the selector stem 130 extends horizontally and is integral with or attached directly to the movement arm 142, and is preferably permanently attached to and inseparable from the movement arm. Thus, there are no pulley systems required between the weight plates and the movement arm, making it the present embodiment inherently safer, as there are no "pinch points" where a user or bystander can injure a finger or other body part. The weight stack assembly comprises a series of weight plates 126, and the "first" plate (i.e., the weight plate 126 closest to movement arm 142) may be permanently attached to the union of the movement arm 142 and the selector stem 130 which, when moved around a pivot point 144, makes the movement arm heavier at the selector stem end than at the pivot point end. Thus, when the user performs the exercise, the selector stem 130 and the first plate travel upwards against the force of gravity to provide resistance to the user.

Figure 8:
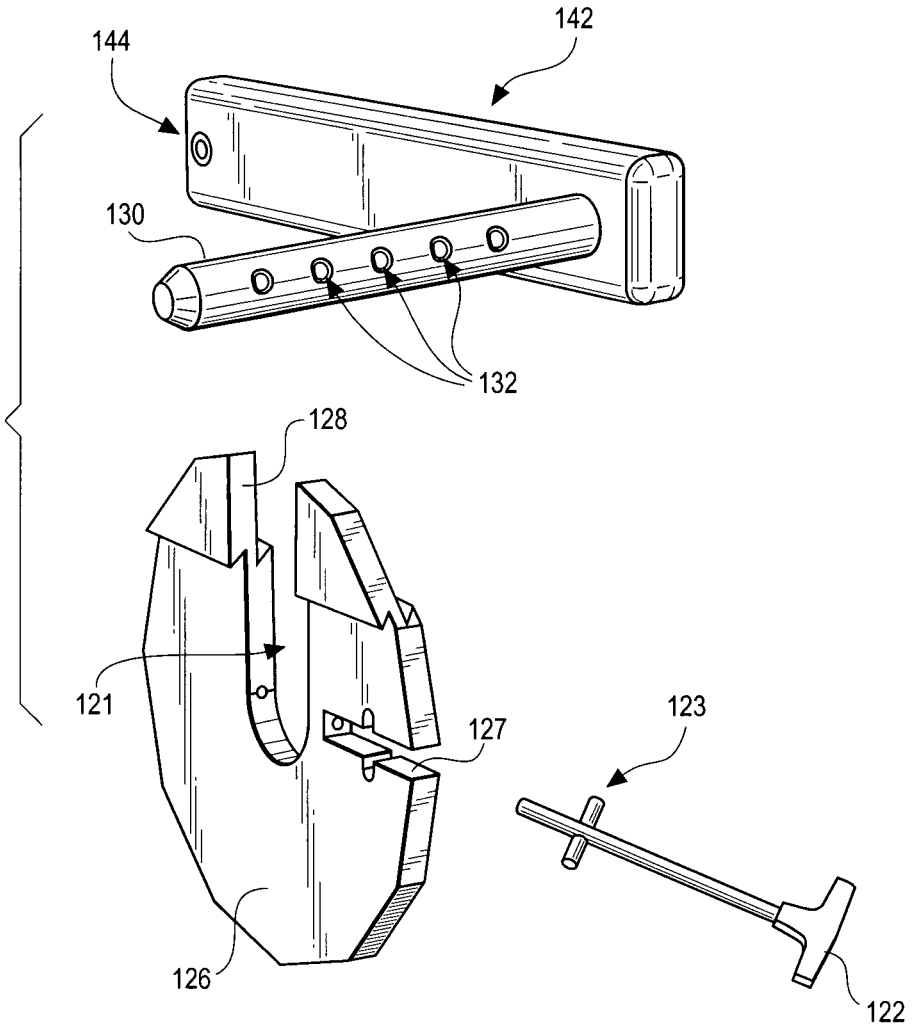
FIG. 8 shows an exploded perspective view of the weight plate and selector pin engagement in accordance with some of the preferred embodiments of the present invention.
Figure 9:
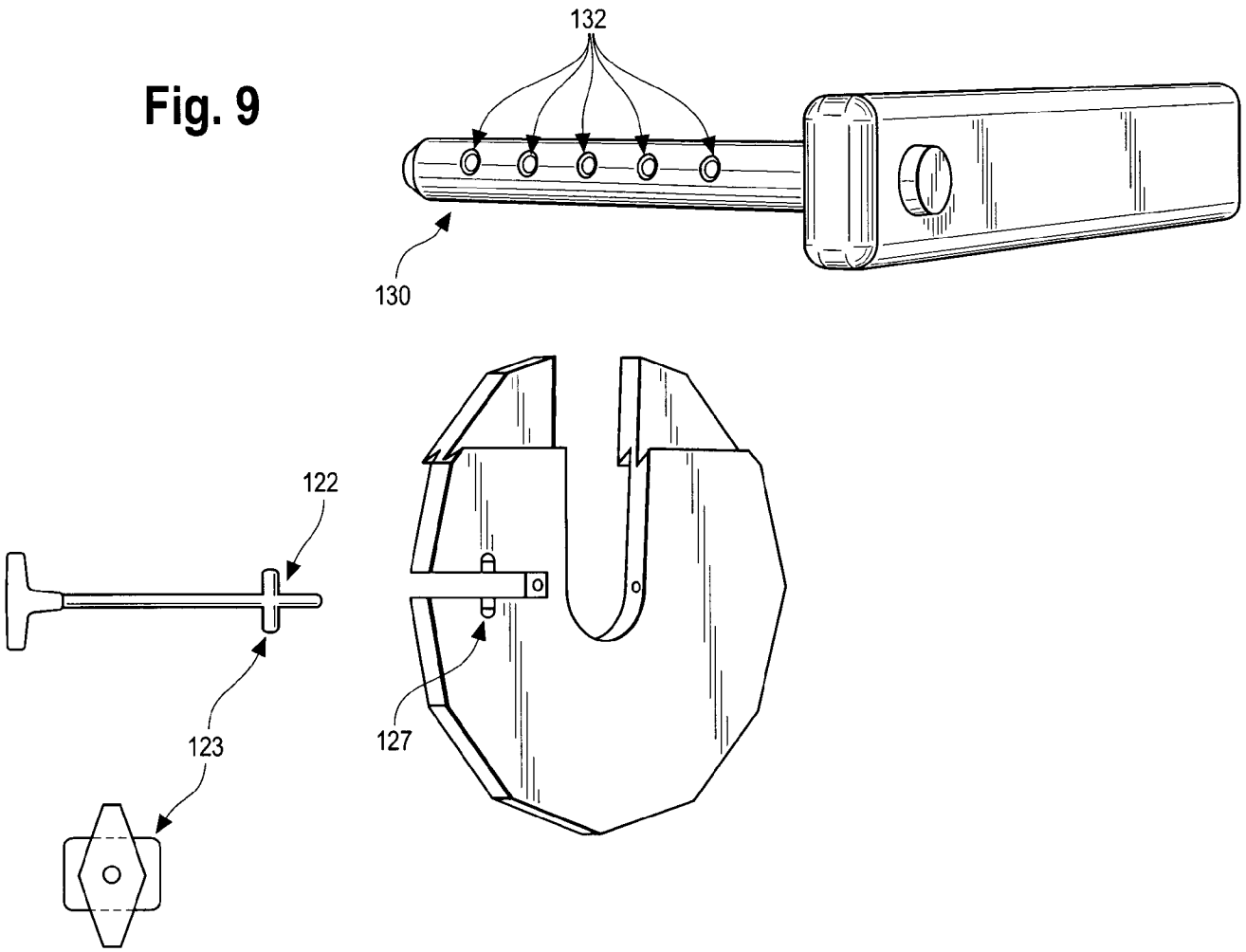
FIG. 9 is an exploded view of the selector pin showing the knob and slider features for engaging with the weight plate cavity of some preferred embodiments of the present invention.
Figure 10:
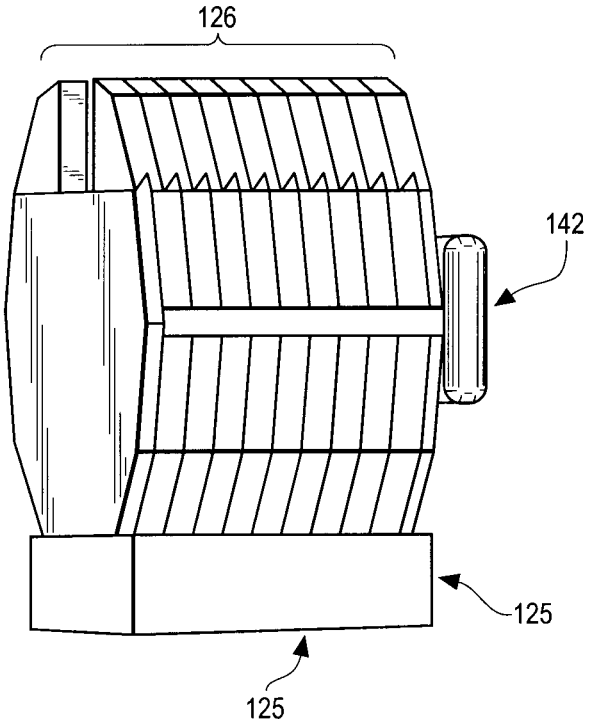
FIG. 10 is a perspective view of the weight stack engaging the movement arm while at rest in the tray as used in some preferred embodiments of the present invention.
Figure 11:
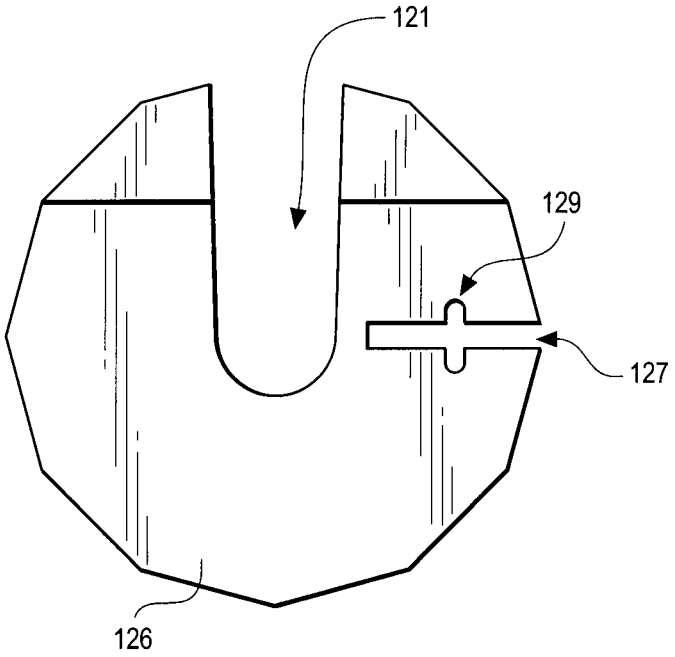
FIG. 11 is a side view of a weight plate as used in some preferred embodiments of the present invention.

In this embodiment, each individual weight plate 126 is of a similar or identical size and shape and are arranged in a horizontal stack, in similar fashion to books on a bookshelf. As shown in FIG. 10, the weight plates 126 at rest are located in a basket or tray 125 or the like, which is permanently attached to and immoveable from the weight lifting apparatus 110. As shown in FIGS. 8-9 and 11, each of the weight plates 126 include an identical, "U shaped" upward radiating cavity 121 so as to permit movement of the selector stem 130 when a given weight plate is not selected. Each weight plate further includes an additional frontward radiating, contoured cavity 127 which forms a track. The engagement of the frontward radiating cavity 127 and the selector pin 122 and slider 123 (which is a type of a car or cart) creates a track for engagement such that the selector pin can be moved from one weight plate 126 to another, while preventing the selector pin 122 from being removed from the weight stack assembly 120. Each weight plate 126 plate has a selector pin throughbore 133 connecting the frontward radiating cavity 127 with the upward radiating cavity to as to be able to receive selector pin 122. Likewise, the selector stem contains a selector pin throughbores 132 such that the selector pin may traverse the weight plate 126 and selector stem 130 when in the engaged position.

Figure 12:
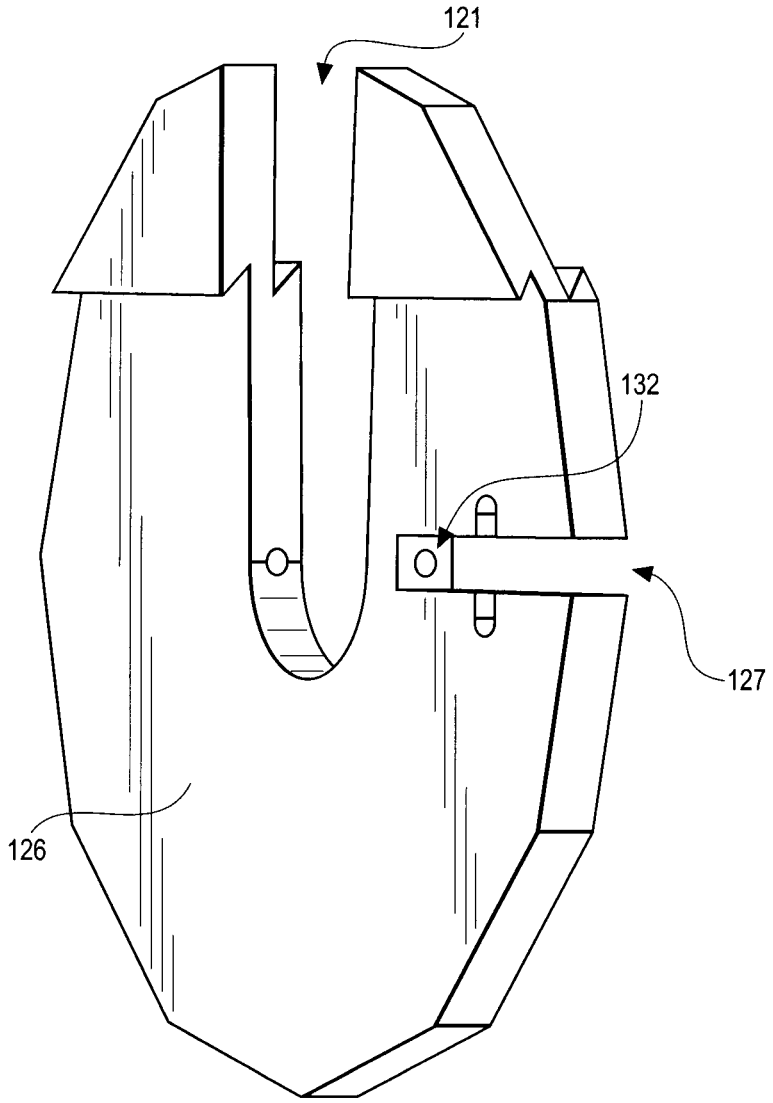
FIG. 12 is a perspective view of a weight plate as used in some preferred embodiments of the present invention.
Figure 13:
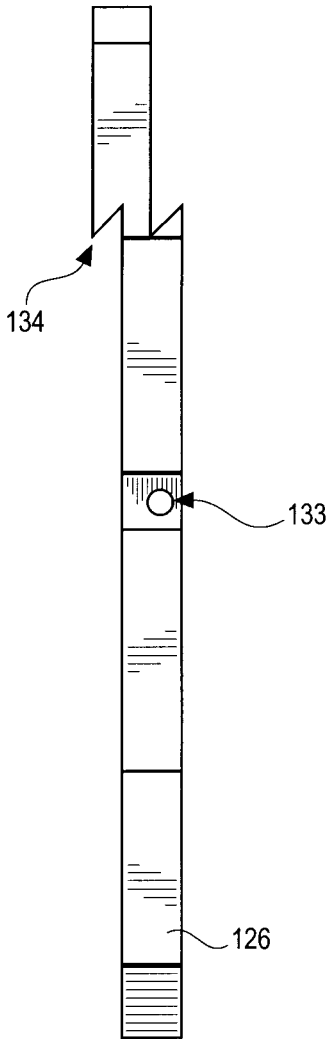
FIG. 13 is a profile view of a weight plate as used in some preferred embodiments of the present invention.
Figure 14:
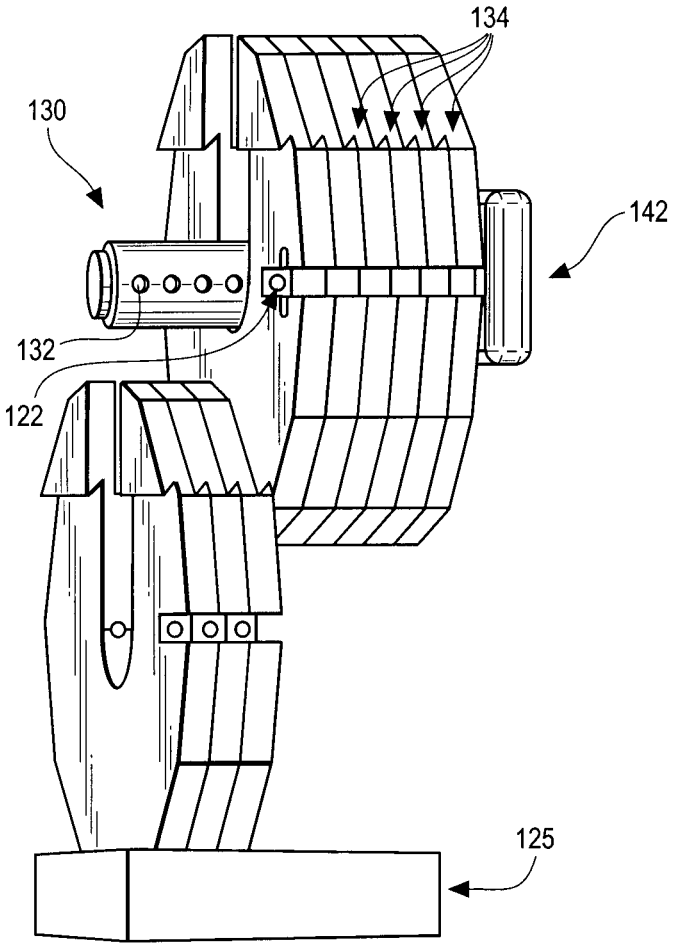
FIG. 14 is a perspective view of the weight stack partially engaged with the selector stem as shown in FIG. 7.

As shown in FIGS. 12-14, this embodiment also includes the use of a configuration for a weight plate 126 that provides for horizontal stacking such that a single selector pin 122, when engaged, can support the lifting of multiple weight plates 126. Each weight plate 126, when viewed from front position, preferably includes an overlapping flange 134 or similar shape that overlaps and forms a union with the lower portion of the adjoining weight plate 126 farther away from the union of the movement arm 142 and the selector stem 130, and is overlapped by and a union is formed by the upper portion of the adjoining weight plate 126 closer to the union of the movement arm 142 and the selector stem 130. The farthest weight plate 126 from the union of the movement arm 142 and the selector stem 130 is of similar or identical size and shape as the other plates in the weight stack 120 but, being the farthest plate in the stack from the union of the movement arm and the selector stem has no farther plate to form a union with and instead overlaps and forms a union with the tray 125.

Figure 15:
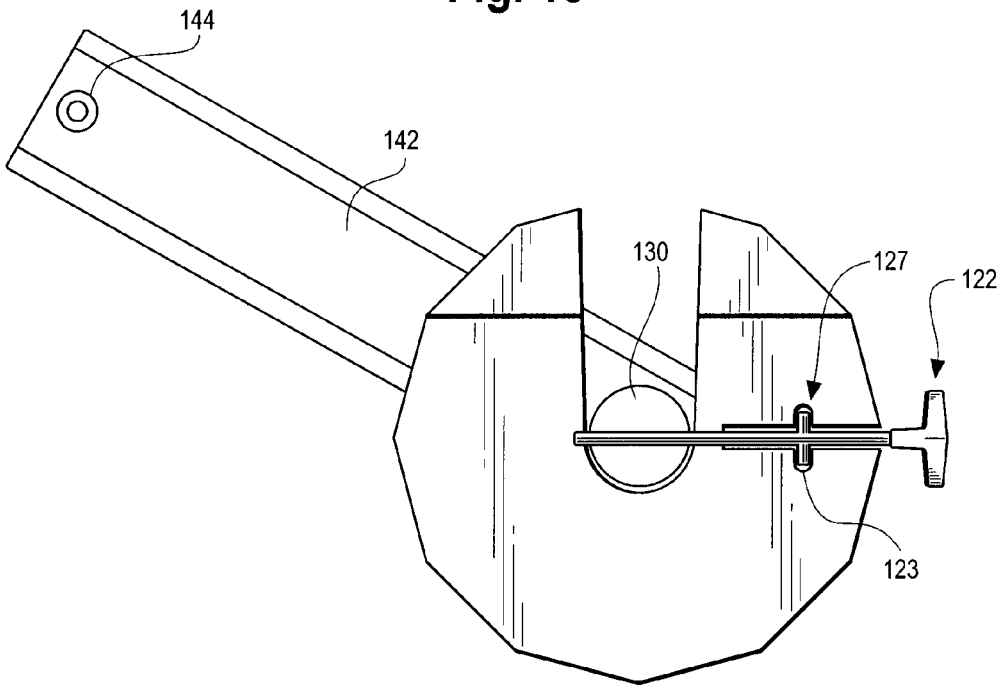
FIG. 15 is an exposed side view of an engaged selector pin and weight stack in operational engagement with the pivot point and movement arm plate as used in some preferred embodiments of the present invention.
Figure 16:
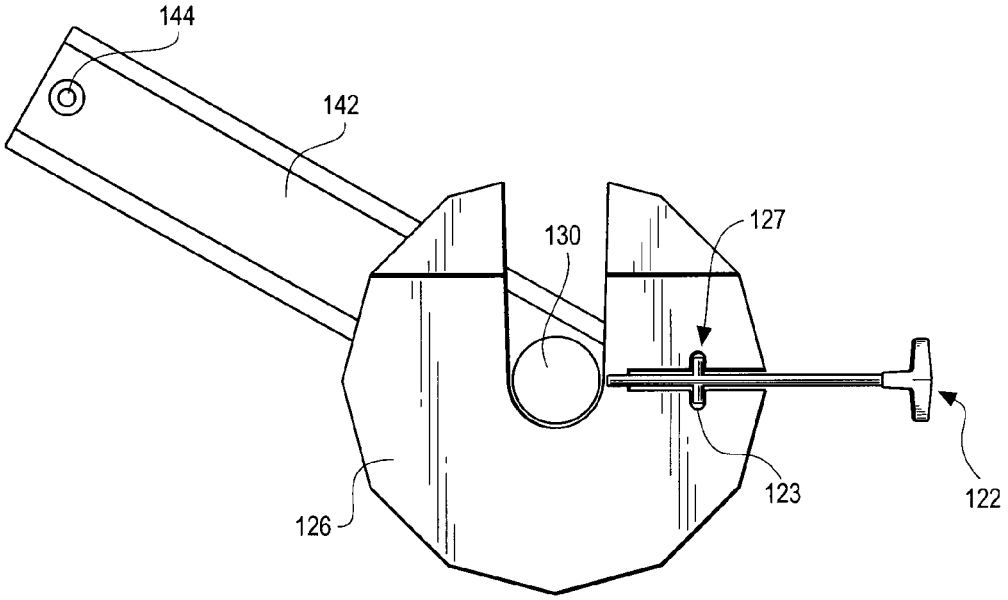
FIG. 16 is an exposed side view of an disengaged selector pin and weight stack in operational engagement with the pivot point and movement arm plate as used in some preferred embodiments of the present invention.
Figure 17A:
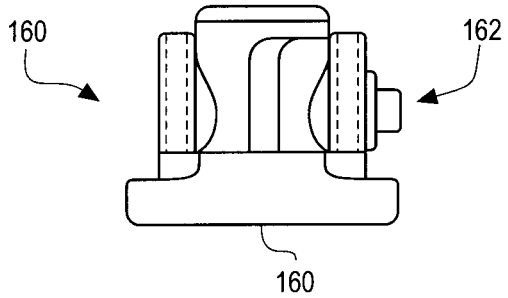
FIG. 17*a-b* are exposed profile views of the selector pin car and track, respectively as used in some preferred embodiments of the present invention.
Figure 17B:
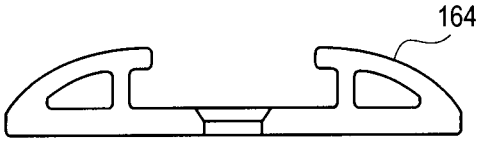
Figure 18A:
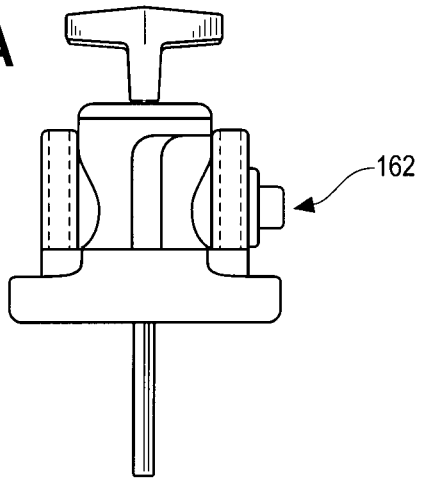
FIG. 18*a-b* are exposed profile views of the selector pin and selector pin car in disengaged and engaged positions, respectively, as used in some preferred embodiments of the present invention.
Figure 18B:
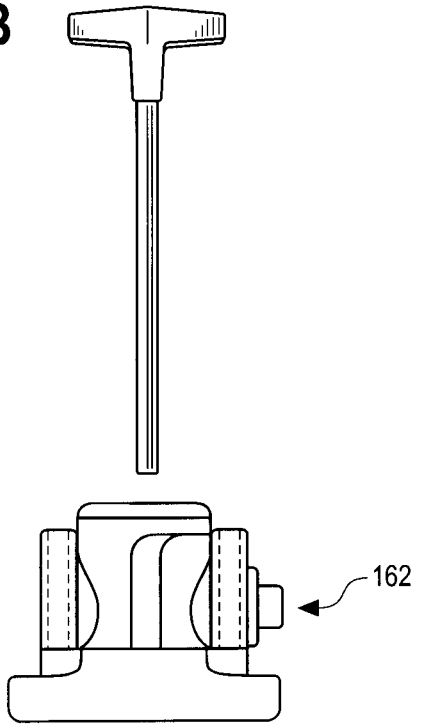

FIGS. 15 and 16 show the engagement and disengagement of the selector pin 122 in this embodiment. When the movement arm 142 and weight plates 126 are in the "at rest position" and there is no user on the machine, the selector stem 130 and permanently attached "First Plate" end of the movement arm, due to the force of gravity, come to rest within the upwardly radiating cavity 121 of weight plates 126, which in turn are held solidly and reliably in place by their overlapping flanges 134 and the tray 125. The user then selects the desired amount of resistance by withdrawing the selector pin into the "disengaged position" and sliding the selector pin 122 using the slider which is sized to slide along the channel formed by the accumulation of front facing cavities 127 formed by the weight plates. If the user desires greater resistance (more weight), the combination of the selector pin 122 and slide 123 is moved outward away from the union of the selector stem 130 and the movement arm 142, and inward towards the union of the selector stem 130 and movement arm 142 if he desires less resistance (less weight). Then the user inserts the selector pin 122 into the "engaged position" through the selector pin throughbore 132 of the weight plate 126 and through the selector pin throughbore 132 in the selector stem 132, the throughbores being properly spaced in order to form a mechanical union between selector pin 122, weight plate 126 and selector stem 130. The user then performs the exercise and is provided resistance based on the number of weight plates 126 located between the insertion point of the selector pin 122 and the union of the movement arm 142 and selector stem 130 due to the overlapping design of the weight plates 126.

This embodiment provides several benefits. Because the union of the movement arm 142, selector stem 130 and first plate 126 is an integrated, there is no need for pulleys, cables or belts between the source of resistance and the movement arm 142. The resistance is effectively and safely put on the movement arm 142 itself. Unlike the traditional weight stack 20, this embodiment has less moving parts and therefore there is less likelihood for mechanical failure and subsequent injury making it inherently safer. Additional design safety comes from the fact that since there are no pulleys, belts or cables, there are no "pinch points" caused by these mechanisms which exist as "necessary evils" on the traditional horizontal weight stack. Further benefit is derived from the fact that due to the fact that there are no guide rods requiring lubrication. With fewer moving parts, breakable mechanisms, or the like, the invention will be less expensive to manufacture and maintain than the traditional horizontal weight stack.

Additionally, due to the non-removable selector pin mechanism the likelihood of the user using the wrong pin in the wrong machine which is a common occurrence and safety hazard in traditional horizontal weight stacks, often resulting in injury and the cost of replacing lost or stolen pins is greatly minimized. Also, due to the overlapping flange design feature, the embodiment only requires the use of one, non-removable selector pin 122 mechanism versus several. The invention is thereby more intuitive and eliminates potential injury and confusion due to inappropriate resistance selection and the need to engage more than one selection mechanism or a different selection mechanism to select a different amount of resistance. Additionally, since there are fewer selection mechanisms and since all plates are of identical size, weight and shape, the cost of manufacture will be less. Unlike the approach commonly referred to in the commercial fitness industry as "plate loaded" equipment, this embodiment also represents a significant improvement for several reasons. Due to the tray 125 and flange 134/overlapping weight plate 126 design, the weight stack assembly 120 is permanently attached to the weight lifting apparatus 110, eliminating the need for the user to locate, gather, lift up and load matching weight plates onto each of the two the movement arms of the equipment which is how current "plate loaded" equipment must be made ready for exercise. This process in and of itself is dangerous as numerous injuries have resulted from the act of loading and unloading the "plate loaded" equipment.

In addition, this embodiment eliminates the need for not only the purchase of weight plates by the health club owner, but storage racks for those weight plates as well. It also leads to a neater and better organized and safer exercise environment. It is a common occurrence for not all users to unload the traditional "plate loaded" equipment after completing their exercise session, leaving the next potential user in the unsafe or compromised position of having to unload the weight plates from the loaded piece of equipment to achieve the desired amount of weight or resistance or, in the event that the loaded weight plates are too heavy to unload, simply get discouraged and not use the piece of exercise equipment at all.

Figure 19A:
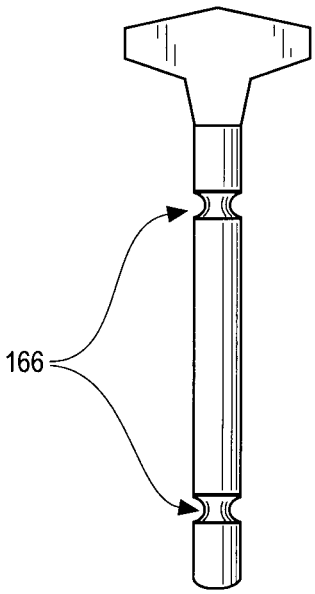
FIG. 19*a-b* are exposed profile views showing details of the selector pin and the stubby plunger used in some preferred embodiments of the present invention.
Figure 19B:
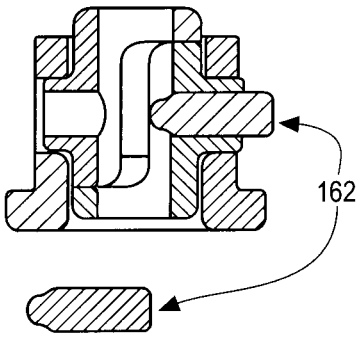
Figure 20A:
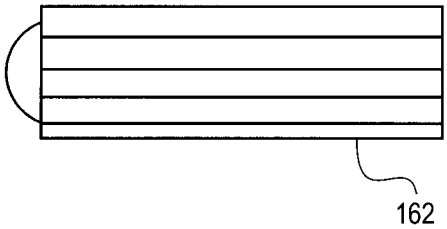
FIG. 20*a-b* are side and exposed side views of the stubby plunger, including the ball bearing component used in some preferred embodiments of the present invention.
Figure 20B:
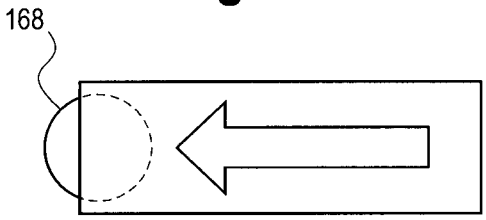

Of course, the present invention includes other embodiments which include other types of weight stack assemblies, even including prior art weight lifting assemblies such as those discloses in FIGS. 1-4. For instance, as shown in FIGS. 17-20, the invention can simply address embodiments which rely upon a selector pin 122 which uses a car 160 or similar sliding mechanism to engage a track 164 or similar channel, but includes a stubby plunger 162 or similar bias and detent mechanism for permanently retaining the selector pin 122 in the car 160, and in turn in the track 164. For instance, as shown in FIGS. 19*a-b*, the selector pin includes grooves 166, with the groove furthest from the knob for a "disengaged" position, and the groove closes to the knob for an "engaged" position. As shown in FIGS. 20*a-b*, the stubby plunger 162 is permanently fixed inside the car 160 and includes a ball bearing 168 which is biased inwards by a spring (not shown). Thus, when the selector pin 122 is inserted or removed by a user, the ball bearing 168 couples with a groove 166 to provide a locking mechanism for the "engaged" or "disengaged" positions.

Figure 21A:
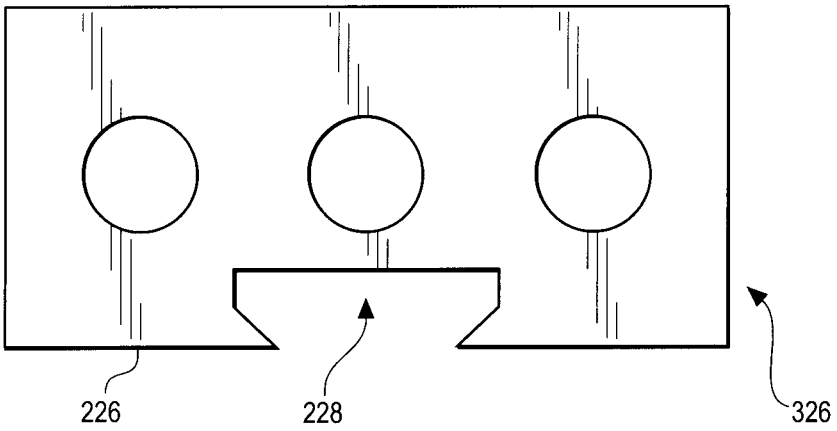
FIG. 21*a-b* are exploded profile views showing the selector pin and cart combination and the weight plate with cart cavity as used in some preferred embodiments of the present invention.
Figure 21B:
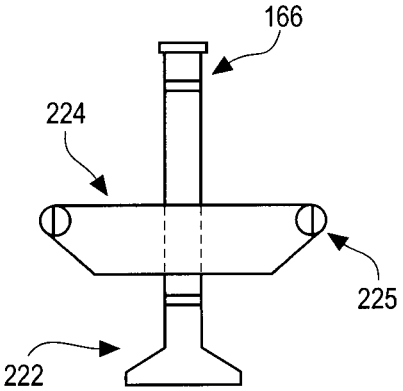
Figure 22:
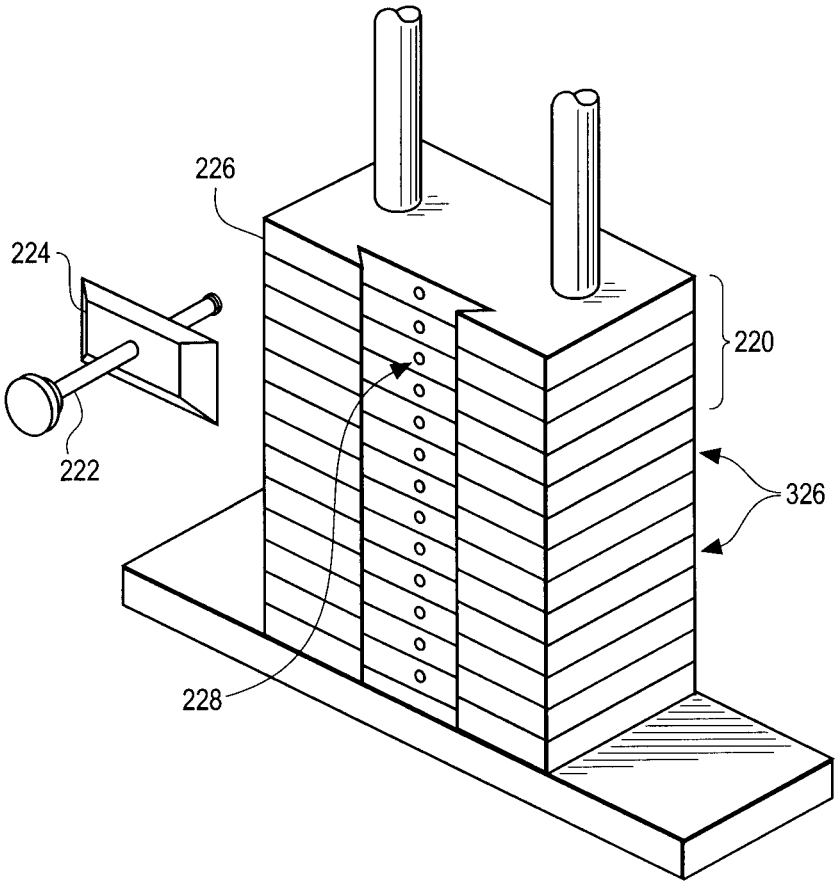
FIG. 22 is an exploded perspective view of the selector pin and cart and weight stack as details in FIG. 21*a-b*.
Figure 23:
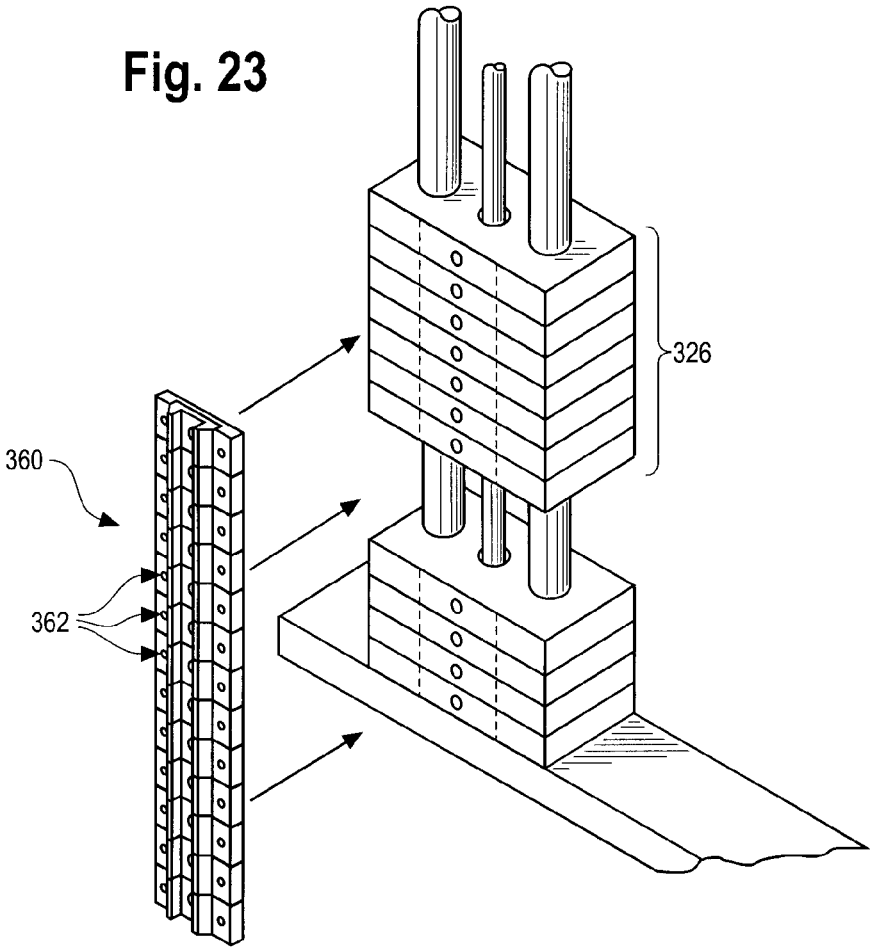
FIG. 23 is an exploded perspective view of an attachable selector pin track used in some preferred embodiments of the present invention.
Figure 24:
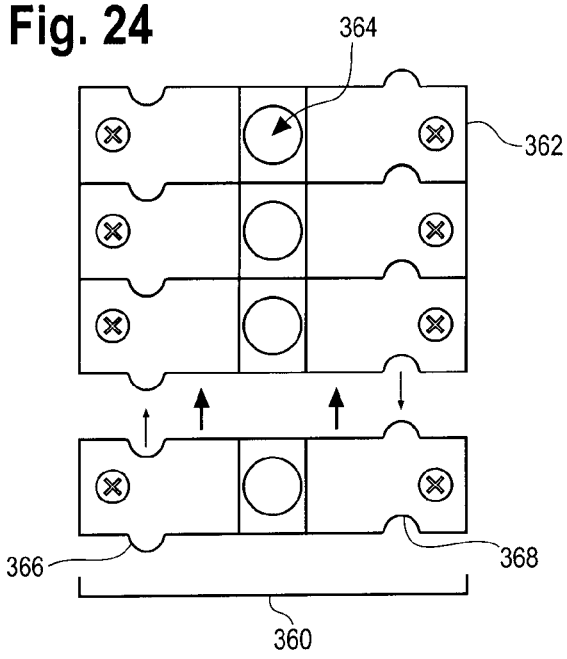
FIG. 24 is a front view showing the detail of track elements of the attachable selector pin track shown in FIG. 23.
Figure 25:
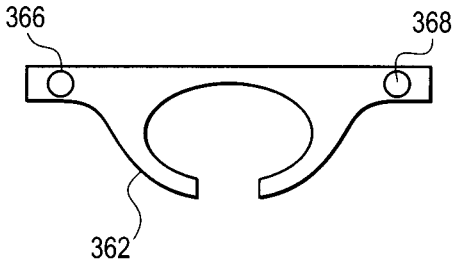
FIG. 25 is a top view showing the profile of a track element as shown in FIG. 24.
Figure 26:
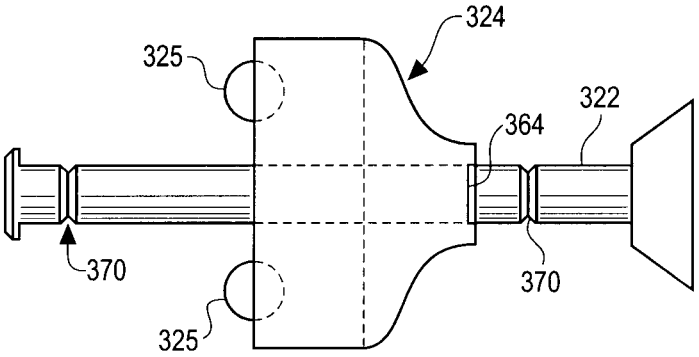
FIG. 26 is a side view of a selector pin and selector pin cart for use the some preferred embodiments of the present invention.
Figure 27A:
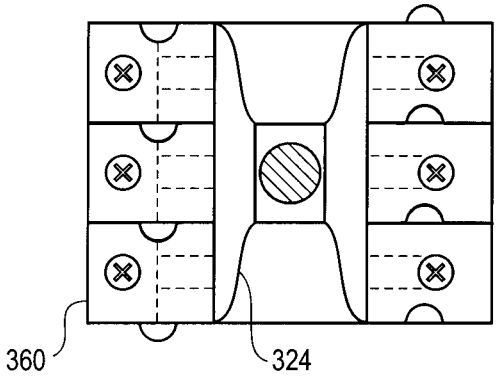
FIG. 27*a-b* is a front view of the selector pin cart are front and top profile views of the selector pin cart of FIG. 26 in operational engagement with the attachable selector pin track shown in FIG. 25.
Figure 27B:
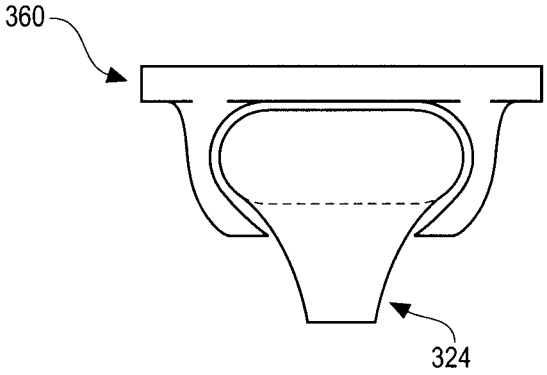

In yet another embodiment, the selector pin 222 and car 224 combination can be sized to fit within a contoured cavity 228 located within a conventional shaped vertically stacked group of weight plates. In this embodiment as shown in FIGS. 21-22, the car includes ball bearings 225 to slide up and down the weight stack 220 until the user selects a desired weight plate corresponding to a desire weight level.

As shown in FIGS. 23-27, the present invention can be used with a selector pin and cart which in connected to a weight stack via an attachable track. In other words, using this embodiment of the present invention permits the present invention to be retrofitted to existing weight lifting devices. In this embodiment, the track 360 is comprised of individual track elements 362 which are permanently affixed to corresponding weight plates 326 in a weight stack 320, each track element 326 having a selector pin throughbore 364, and each element being capable of locking or connecting to other, similar elements using male 366 and female 368 connectors. Collectively, the track provides a channel for a cart 324 to slide through, the cart having ball bearings 325 to enable sliding up and down the track to the desired level in the track 360 corresponding to a desired level in the weight stack 320, such that the selector pin 322 (which is permanently connected to cart 324) can extend through the selector pin throughbore 364 and the weight plate 326, using grooves 370 to facilitate engaged and disengaged positions.

Figure 28:
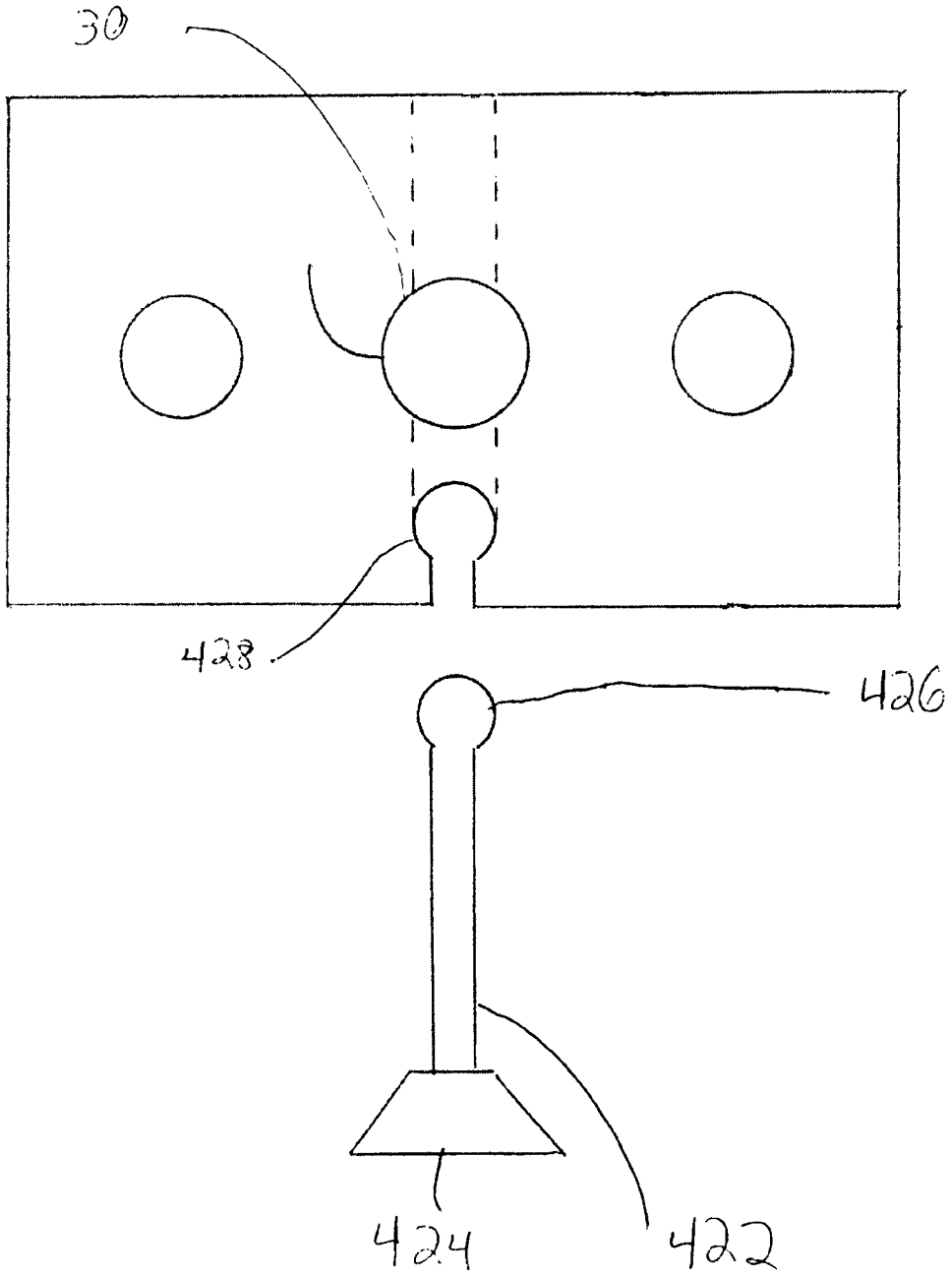
FIG. 28 shows an exploded profile view showing an alternative of the weight plate with a bulbous pin cavity as used in some preferred embodiments of the present invention.

In yet another alternative embodiment as shown in FIG. 28, the selector pin 422 can be in the shape of a bulbous pin sized to fit within a contoured cavity 428 located within a conventional shaped vertically stacked group of weight plates. In this embodiment, the selector pin 422 is embedded and unremoveable from the weight plates due to contoured, enveloping cavity 428 within in each plate while still allowing for freedom of selection on a piece of variable resistance.

The selector pin 422 has a knob 424 on the user end that the user grasps to disengage the union between the selector pin 422 and the selector stem 30, which runs vertically downward through the center of each plate. The "front end" of the pin, the end opposite the "knob end" is bulbous and larger in radius, diameter and circumference at the tip than at the shaft of the pin, which is consistent in size, but thinner than the tip. The bulbous tip 426 of the pin is slightly smaller than the weight plate throughbores 32 running horizontally through each plate allowing for insertion and union with the selector stem 30. However, the bulbous tip 426 is slightly larger than the entrance to the contoured, enveloping cutout in each plate, thus preventing complete removal from any plate in the when the pin 422 is moved by the user into the extracted position, breaking the union between the selector pin and the selector stem.

When the invention is in the extracted position the bulbous tip 426 of the pin 422 is free to travel up and down inside a contoured, enveloping cutout cavity that is formed by an identical cutout in each plate, shaped identically to, but slightly larger than the profile of the extracted bulbous tip 426. This forms a continuous cavity running vertically along the face of the weightstack such that the bulbous end of the tip cannot be removed from, with the bulbous tip being enveloped by the contoured cavity and the shaft, being thinner, extrudes from the entrance of the cavity. This creates a system where the pin, when put in the extracted position by the user so as to be disengaged from the union with selector stem and removed to a position where the bulbous tip is located in the enveloping cavity, can travel vertically from one plate to another while remaining unremoveable from the weightstack itself. In this system, the knob 424 is too large to be inserted into the contoured cavity 428 and the bulbous tip 426 is too large to be removed from the cavity. However, freedom of selection is still allowed by the system as a whole when the weight plates are in the "stacked" continuous fashion. Therefore, when the user is not using the machine for exercise and the weight plates are stacked one on top of the other, the user can slide the pin up and down uninterrupted without fully removing the pin from the stack in order to select what weight amount he wants to lift by then inserting the pin into the horizontal throughbore in any plate into the engaged position forming a union with the selector stem 30. This allows the user to select the desired weight level or resistance. The cutout or contoured cavity on the bottom most plate and the plate directly below the topmost plate i.e. the second plate, do not extend to its full cavity size (i.e., such that the bulbous tip 426 cannot pass freely therethrough) vertically from surface to surface of those two plates exclusively in order to trap the pin within the weightstack when extracted from the selector stem and in the disengaged position. Such a cavity can be tapered or simply discontinue at the appropriate point in the bottom most plate or the second plate as desired in order to best trap the bulbous tip 426, and by extension, the selector pin.

Figure 29A:
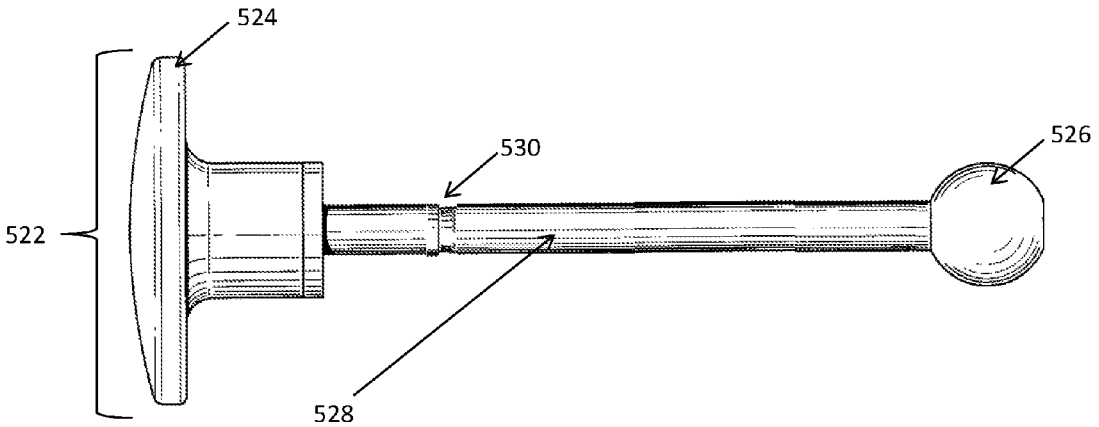
FIGS. 29*a-b* depict side views of a further selection pin configuration in accordance with another alternative embodiment of the present invention in disengaged and engaged positions, respectively.
Figure 29B:
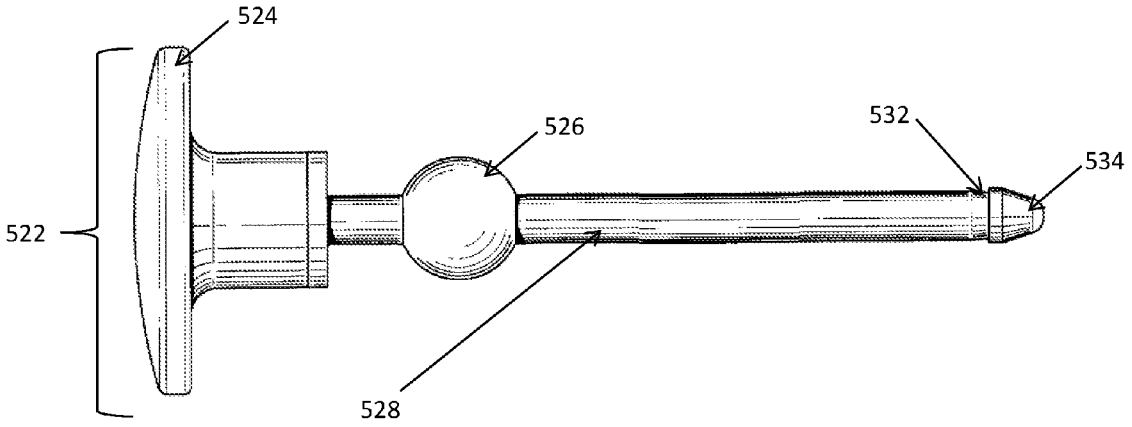

As seen in FIG. 29*a-b*, yet another alternative embodiment of the selector pin 522 is shown in FIG. 28. The selector pin 522 in this embodiment is in the shape of a bulbous pin sized to fit and operate within a contoured cavity (not shown) just like the weight plate shown in FIG. 28. In this alternative, the selector pin 522 has a knob 524 on the user end that the user grasps to disengage the union between the selector pin 522 and the selector stem (not shown). The selector pin 522 further includes a bulb 526 which slidingly engages the shaft 528 of the selector pin 522. The shaft 528 further includes detents 530, 532 near the knob 524 and at the tip 534 of the pin, respectively, which can engage an interior ridge (not shown) inside the bulb 526. This detent/ridge engagement limit the amount of sliding by the bulb 526 on the shaft 528 so as to ensure that the bulb 526 stays attached to the selector pin 522 at all time during normal operation. The bulb 526 is slightly larger than the entrance to the contoured, enveloping cutout in each plate, thus preventing complete removal from any plate in the when the pin 522 is moved by the user into the extracted position (FIG. 29*a*), breaking the union between the selector pin and the selector stem. However, when the user slides the selector pin 522 forward (as shown in FIG. 29*b*), the tip 534 and the nearby portion of the shaft 528 is slightly smaller than the weight plate throughbores 32 running horizontally through each plate, thus allowing for insertion and union with the selector stem 30. However, the bulb 526 is slightly larger than such throughbores, thus keeping the bulb 526 in the contoured, enveloping cutout in each plate.

The above description is not intended to limit the meaning of the words used in the following claims that define the invention. Rather, it is contemplated that future modifications in structure, function or result will exist that are not substantial changes and that all such insubstantial changes in what is claimed are intended to be covered by the claims. For instance, the particular plate geometry and the presence or absence of guide rods may or may not vary depending upon (for instance) the particular weight lifting exercise. Similarly, while the preferred embodiments of the present invention focus upon the direct translation of the user's energy from the movement arm to the weight stack without the need for pulleys belts and the like, those of skill will understand the applicability of the present invention (e.g., the selector pin/car feature) to other weight lifting devices which require such machines. Also, the cart and track connection could be configured such that the cart surrounds the track, instead of being contained within a channel of the track. Likewise, it will be appreciated by those skilled in the art that various changes, additions, omissions, and modifications can be made to the illustrated embodiments without departing from the spirit of the present invention. All such modifications and changes are intended to be covered by the following claims.

I claim:

1. A weight selector assembly for selecting a desired weight level from at least two weight levels, the assembly comprising:

a. a moveable ball for selectively engaging with one of a plurality of weight levels;

b. a track defined within the at least two weight levels, the track continuously engaged with the moveable ball for guiding the ball between a plurality of engagement points corresponding to the plurality of different weight levels, each of the plurality of engagement points further having a corresponding cavity for retaining the movable ball when not in use; and c. a non-removable selector pin integrated with the moveable ball, and movable with the movable ball from at least a first engaged position and a second, disengaged position, wherein the first engaged position mechanically couples one of the plurality of engagement points, and the second disengaged position retains the ball so as to preclude the removal of the selector pin, the non-removable selector pin includes a shaft, and the movable ball moves along the shaft by sliding between the first engaged position and the second disengaged position.

2. The assembly of claim 1, wherein the track comprises a plurality of track segments corresponding to the plurality of different weight levels formed by each of said corresponding cavity for retaining the movable ball.

3. The assembly of claim 2, wherein, in the plurality of track segments, each of the plurality of track segments defines a top opening and a bottom opening aligned and sized to enable the movable ball of the selector pin to travel along the track while in the disengaged position.

4. The assembly of claim 3, wherein the selector pin has a knob coupled to the shaft, the shaft defines a first detent proximate to the knob and a second detent proximate to a tip of the shaft, such that the axial movement of the movable ball along the selector pin is confined between the first detent and the second detent.

5. The assembly of claim 1, wherein the selector pin has a knob coupled to the shaft.

6. The assembly of claim 5, wherein the shaft defines a detent proximate to a tip of the shaft, such that the axial movement of the movable ball along the selector pin is confined by the detent.

7. The assembly of claim 1, wherein the moveable ball is retained in the track in both the first engaged position and the second, disengaged position.

8. A weight selector assembly for selecting a desired weight level from at least two weight levels, the assembly comprising:

a track defined along the at least two weight levels, guiding between a plurality of engagement points corresponding to the plurality of different weight levels, each of the plurality of engagement points aligned with a corresponding track segment; and a selector pin for selectively engaging with one of the plurality of weights via one of the plurality of engagement points, the selector pin having:

an elongated axial shaft, and a retaining portion movably disposed on the shaft, the retaining portion slides axially along the shaft between an engaged position and a disengaged position, in which in the engaged position the selector pin mechanically couples one of the plurality of engagement points, and in the disengaged position the retaining portion is captured within the track so as to preclude the removal of the selector pin, wherein further, in the disengaged position, the retaining portion of the selector pin is confined by the track such that the selector pin can travel along the track to enable selection of a weight of the plurality of weight levels.

9. The assembly of claim 8, wherein, in the plurality of track segments, each track segment defines a top opening and a bottom opening aligned and sized to enable the movable ball of the selector pin to travel along the track while in the disengaged position.

10. The assembly of claim 9, wherein the selector pin has a knob coupled to the shaft, the shaft defines a first detent proximate to the knob and a second detent proximate to a tip of the shaft, such that the axial movement of the movable ball along the selector pin is confined between the first detent and the second detent.

11. The assembly of claim 8, wherein the selector pin has a knob coupled to the shaft.

12. The assembly of claim 11, wherein the shaft defines a first detent proximate to the knob and a second detent proximate to a tip of the shaft, such that the axial movement of the movable ball along the selector pin is confined between the first detent and the second detent.

13. The assembly of claim 8, wherein the retaining portion is retained in the track in both the engaged position and the disengaged position.

14. The assembly of claim 8, wherein the shaft defines a detent proximate to a tip of the shaft, such that the axial movement of the movable ball along the selector pin is confined by the detent.

15. A weight selector assembly for selecting a desired weight level from at least two weight levels, the assembly comprising:

a weight stack comprising a plurality of weights in an aligned arrangement, the weight stack having:

a plurality of engagement points corresponding to the plurality of weights, and a track defined by the weight stack for guiding between the plurality of engagement points; and a selector pin for selectively engaging with one of the plurality of weights via one of the plurality of engagement points, the selector pin having:

a knob, an elongated axial shaft extending from the knob, and a retaining portion movably disposed on the shaft, the retaining portion slides axially along the shaft between an engaged position and a disengaged position, in which in the engaged position the selector pin mechanically couples one of the plurality of engagement points, and in the disengaged position the retaining portion is captured within the track so as to preclude the removal of the selector pin, wherein further, in the disengaged position, the retaining portion of the selector pin is confined by the track such that the selector pin can travel along the track to enable selection of a weight of the plurality of weights.

16. The assembly of claim 15, wherein each of the plurality of weights provide a track segment that contributes to form the track.

17. The assembly of claim 16, wherein each track segment further defines a top opening and a bottom opening aligned and sized to enable the retaining portion of the selector pin, in the disengaged position, to travel along the enveloping cavity of the weight stack.

18. The assembly of claim 15, wherein the shaft defines a detent proximate to a tip of the shaft, such that the axial movement of the movable ball along the selector pin is confined by the detent.

19. The assembly of claim 15, wherein the retaining portion is retained in the track in both the engaged position and the disengaged position.

20. The assembly of claim 15, wherein the shaft defines a first detent proximate to the knob and a second detent proximate to a tip of the shaft, such that the axial movement of the movable ball along the selector pin is confined between the first detent and the second detent.

* * * * *